US007032418B2

(12) United States Patent
Martin et al.

(10) Patent No.: US 7,032,418 B2
(45) Date of Patent: Apr. 25, 2006

(54) VERTICAL DOOR LOCKING SYSTEM

(75) Inventors: Dale Martin, East Lyme, CT (US); Ronald S. Slusarski, Narragansett, RI (US); Gurdev Bains, Wolcott, CT (US); John Hayde, Alpharetta, GA (US); Shilin Yang, Cumming, GA (US); Herb Guck, Roswell, CT (US); Thomas E. Roth, Reno, NV (US); Dennis E. Wojdan, Sparks, NV (US); Robert C. Hunt, Reno, NV (US); Larry G. Corwin, Fernley, NV (US); Joshua M. Huff, Sparks, NV (US)

(73) Assignees: Sargent Manufacturing Company, New Haven, CT (US); Single Access Lock, Inc., Duluth, GA (US); Securitron Magnalock Corporation, Sparks, NV (US)

( * ) Notice: Subject to any disclaimer, the term of this patent is extended or adjusted under 35 U.S.C. 154(b) by 129 days.

(21) Appl. No.: 10/828,566

(22) Filed: Apr. 21, 2004

(65) Prior Publication Data

US 2005/0235711 A1 Oct. 27, 2005

(51) Int. Cl.
*E05B 65/08* (2006.01)
*E05B 47/06* (2006.01)

(52) U.S. Cl. ..... 70/99; 70/100; 70/278.7; 70/279.1; 70/DIG. 11; 292/341.16; 292/DIG. 36

(58) Field of Classification Search ..... 70/95–100, 70/278.1, 278.2, 278.3, 278.7, 279.1, 257, 70/DIG. 11, 277; 292/DIG. 32, DIG. 33, 292/DIG. 36, 341.15, 341.16, 341.17
See application file for complete search history.

(56) References Cited

U.S. PATENT DOCUMENTS

| | | | | | |
|---|---|---|---|---|---|
| 508,518 | A | * | 11/1893 | Johnson | 292/341.16 |
| 1,618,738 | A | * | 2/1927 | Weiss | 292/341.16 |
| 3,083,562 | A | * | 4/1963 | Weizer | 70/271 |
| 3,152,826 | A | * | 10/1964 | Smith | 292/341.16 |
| 3,638,461 | A | * | 2/1972 | Watson | 70/92 |
| 4,087,121 | A | * | 5/1978 | Davis | 292/139 |
| 4,830,415 | A | * | 5/1989 | Nelson | 292/134 |
| 5,195,792 | A | * | 3/1993 | Stendal | 292/341.16 |

(Continued)

OTHER PUBLICATIONS

*Locknetics. CM Computer Manages Electronic Locking Systems.* IR Security & Safety Catalog—2000, pp 2-3.

(Continued)

*Primary Examiner*—Lloyd A. Gall
(74) *Attorney, Agent, or Firm*—DeLio & Peterson, LLC

(57) ABSTRACT

A vertical door locking system includes a door lock with a deadbolt that moves horizontally, a striker with an upward facing strike opening that vertically receives the deadbolt and a lock controller. The striker includes an electrically operated catch to engage and release the deadbolt. The door lock and striker are mounted opposite each other, one to the vertical door and the other to an adjacent fixed mounting point. The lock controller electrically operates the striker to release the deadbolt and allow it to move vertically out of engagement with the striker for primary access to a secure area and the door lock allows the deadbolt to be retracted horizontally away from the striker for secondary access. A remotely located control system optionally controls the lock controllers of multiple doors and a central office control system is optionally connected to multiple remotely located control systems.

49 Claims, 5 Drawing Sheets

U.S. PATENT DOCUMENTS

| | | | | |
|---|---|---|---|---|
| 5,575,515 | A * | 11/1996 | Iwamoto et al. | 292/341.17 |
| 6,374,653 | B1 * | 4/2002 | Gokcebay et al. | 70/278.3 |
| 6,454,324 | B1 * | 9/2002 | Lewis et al. | 292/341.16 |
| D470,033 | S | 2/2003 | Fleury et al. | D8/302 |
| 6,848,729 | B1 * | 2/2005 | Caspi et al. | 292/341.16 |
| 2004/0089035 | A1 * | 5/2004 | Ciezki et al. | 70/208 |

OTHER PUBLICATIONS

*Locknetics. When Life Safety+Security Matter.* Locknetics Security Engineering Catalog—Feb. 1998, pp. 10-26.

*V Series, Stand-Alone Electronic Locks*. Best Access Systems Catalog—Jul. 1998, pp. 2-11.

* cited by examiner

VERTICAL DOOR LOCKING SYSTEM

BACKGROUND OF THE INVENTION

1. Field of the Invention

The present invention relates to locks for doors that open vertically, such as garage doors, rollup doors and overhead doors. More specifically, the present invention relates to electrically operated locks for vertical doors and to systems for controlling multiple, electrically operated, vertical door locks from a central location.

2. Description of Related Art

Self-storage centers typically provide multiple individual storage areas, each of which is accessible through a lockable, vertically opening, rollup door. In existing installations, each customer is provided with a mechanical key to open and access a corresponding assigned storage area.

When a key is lost, or the storage area is rented to another customer, the key must be replaced and/or the lock must be changed. This represents an ongoing problem due to both cost and the labor time required. Locks and keys must also be changed when a customer has failed to pay applicable storage fees. If a self-storage facility permits its customers to access storage areas 24 hours a day, but is staffed only during business hours, problems arise when access must be restored during non-business hours to a storage area previously made inaccessible for non-payment. Although a customer can easily make payments via a phone or over the Internet, it still requires a maintenance worker at the local storage facility to restore access to the storage area.

It is also desirable for a self-storage facility to be able to monitor and control when secured areas are being opened and by whom. This is not possible with conventional mechanical lock systems currently used by the self-storage industry. Monitoring for forced entry is also desirable, but is not currently available in an integrated system with electronic locks and remote access control.

Bearing in mind the problems and deficiencies of the prior art, it is therefore an object of the present invention to provide a vertical door locking system that electronically controls access to a secure area.

A further object of the invention is to provide a vertical door locking system that includes mechanical overrides for alternative entry and exit from the secure area.

It is another object of the present invention to provide a vertical door locking system that can remotely change access codes for accessing a secure area and can operate with multiple access codes.

Still other objects and advantages of the invention will in part be obvious and will in part be apparent from the specification.

SUMMARY OF THE INVENTION

The above and other objects, which will be apparent to those skilled in art, are achieved in the present invention which is directed to a vertical door locking system having a deadbolt, an electrically operated striker and an electric lock controller. The striker includes a strike opening that for vertically receiving the deadbolt and an electrically operated catch mechanism for engaging and releasing the deadbolt from the strike opening. The deadbolt and striker are mounted opposite one another, one to a door that opens and closes vertically and the other to an adjacent fixed mounting point. The electric lock controller is mounted outside the secure area and controls the catch mechanism in response to receiving a secure access key.

The secure access key may be a manually entered personal identification number (PIN), a magnetically stored key on a card, or a wirelessly transmitted key via a proximity card, smart card, radio frequency identification (RFID) tag or other conventional method of providing an identifying code for accessing a secure area. Upon receipt of the correct secure access key, the lock controller releases the deadbolt from the strike opening to provide access to the secure area. The lock controller may be provided with a keypad to receive the PIN, a wireless receiver to receive the PIN, a magnetic card reader, or combinations of the above and/or other secure systems for entering a secure access key.

In a preferred embodiment of the invention, the deadbolt is integrated into a door lock mechanism and is horizontally retractable out of engagement with the striker by rotating a conventional key in a lock cylinder in the door lock. This provides an alternative method of entering the secure area. The key for the door lock may be a master key for multiple door lock in multiple vertical door locking systems of a self-storage facility.

The electric lock controller may be provided with a status indicator to indicate the striker catch mechanism has released the deadbolt to permit access to the secure area and/or whether the vertical door is locked or unlocked. The striker may be provided with a switch acting as a sensor to indicate whether the catch mechanism has released the deadbolt to permit access to the secure area.

In another aspect of the invention, the electric lock controller may store multiple different access keys corresponding to different users and the controller may temporarily disable an access key to prevent access to the secure area.

In still another aspect of the invention, the striker includes an override accessible from within the secure area to release the deadbolt from the strike opening and allow the vertical door to open to exit the secure area.

The striker is preferably designed for mounting to a vertical track for the door and the deadbolt is designed to be mounted to a panel of the vertical door.

The electric lock controller may include a storage memory for storing transaction data related to accessing the secure area. The transaction data typically includes a date and time the electric lock controller has released the deadbolt to permit access to the secure area. The transaction data may also include an identification corresponding to the secure access key and/or an identification corresponding to the secure area being accessed.

The catch mechanism is designed to pivot such that it automatically engages the deadbolt as the door is vertically closed. In the preferred design, a locking arm, driven by a solenoid, pivots between a locked position and an unlocked position to lock the catch. A manual override is connected to the locking arm and is accessible from outside the striker to mechanically pivot the locking arm to the unlocked position and disengage the deadbolt from the striker, allowing the vertical door to open and the user to exit the secure area. This prevents a user from being inadvertently locked within the secure area.

Also in the preferred design, the catch mechanism includes at least one roller contacting the deadbolt when the deadbolt is engaged by the catch mechanism.

In still another aspect of the invention, multiple vertical door locking units comprising the lock controller, the striker and the door lock having a deadbolt are connected to a remotely located control system. The remotely located control system is operable to remotely disable access to the secure area via the electric lock controller, to monitor entry and exit, and to perform other control functions at the electric lock controller for each secure area. The remotely located control system is typically at a relatively nearby location to the secure areas being controlled and may be connected via wires or wirelessly to the lock controllers.

In a further aspect of the invention, one or more remotely located control systems may be connected via a network, such as the Internet or a similar packet switching network, to a central office control system that is operable to remotely control access to multiple secure areas via their corresponding electric lock controllers.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

Figure 2:
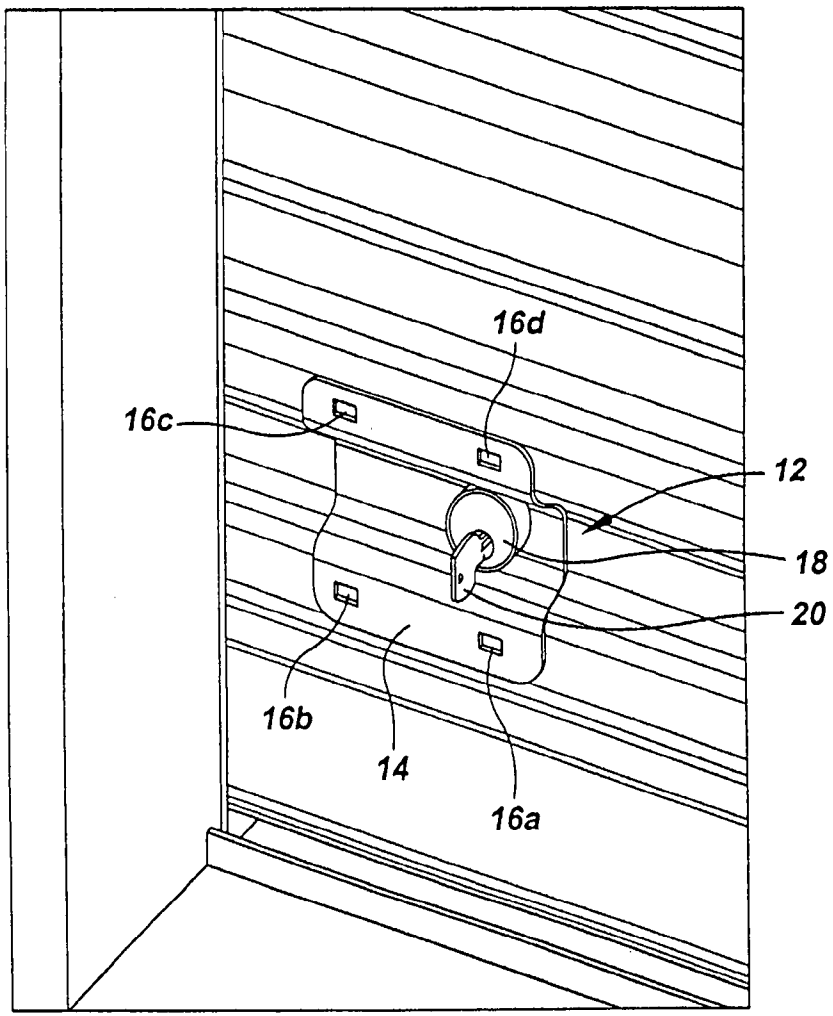
FIG. 2 is a perspective detail view of the outside of the door lock portion of the vertical door locking system seen in FIG. 1.
Figure 1:
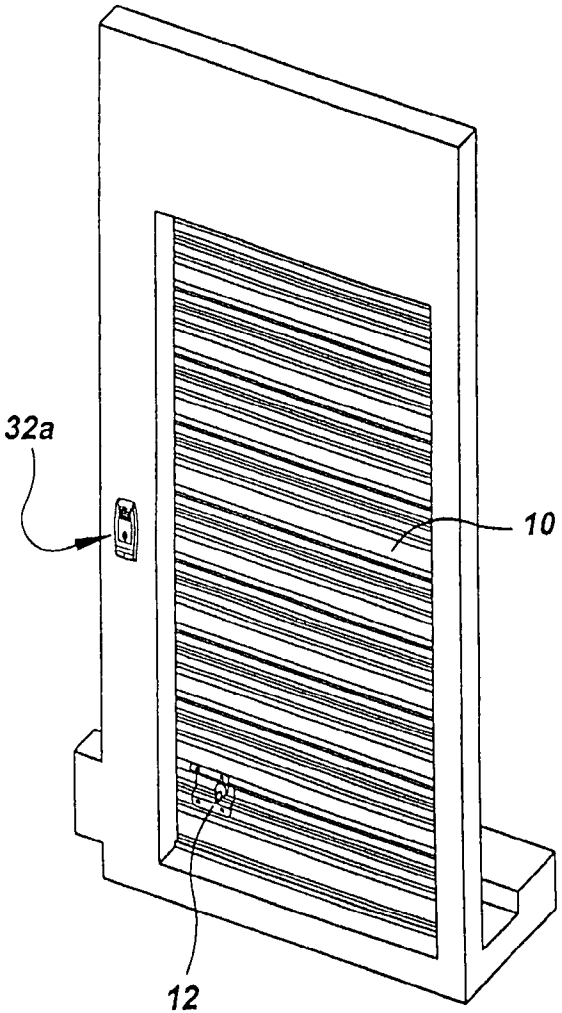
FIG. 1 is a perspective view of the outside of a vertical door having a vertical door locking system according to the present invention installed thereon. Only the outside half of the electronic controller and the outside of the door lock can be seen in this view, which is taken from outside the secure area with the vertical door closed.

FIG. 1 illustrates a vertical rollup door 10 of the type typically used in a self-storage facility. A door lock 12 is installed in the door (see FIG. 2) and includes a shaped escutcheon 14 bolted to the door through bolt holes 16*a*–16*d* with square head carriage bolts (not shown). The rollup door is typically made up of multiple horizontal panels that allow the door to rollup or turn horizontal at the top of the door frame as the door is opened. The shape of the escutcheon 14 conforms to the three dimensional shape of the front surface formed by the horizontal panels of the rollup door 10.

Figure 4:
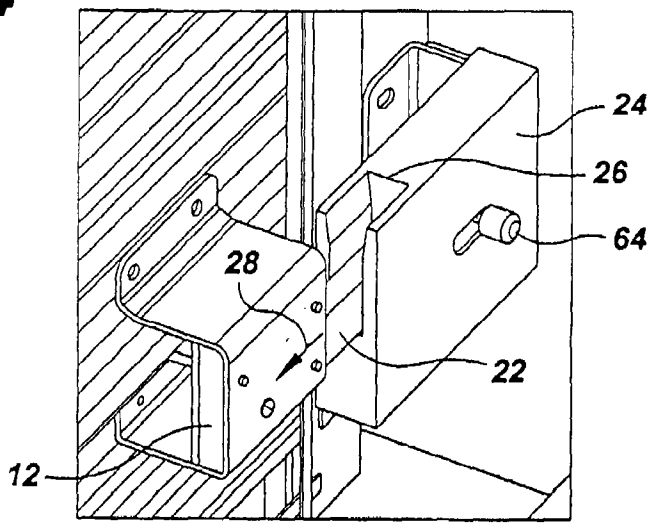
FIG. 4 is a perspective detail view as seen from the left inside of the secure area showing the door lock and striker portions of the vertical door locking system seen in FIG. 1.
Figure 5:
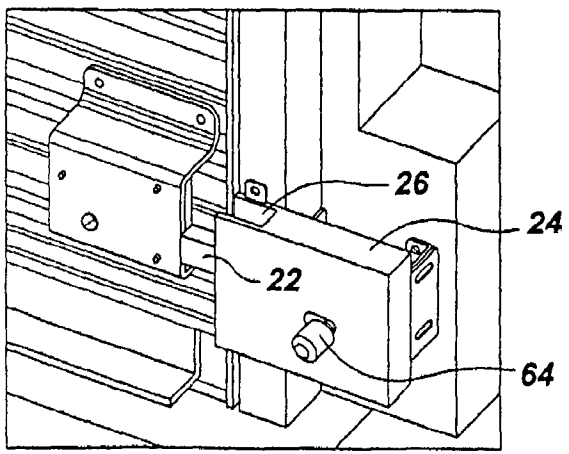
FIG. 5 is a perspective detail view as seen from the right inside of the secure area showing the door lock and striker portions of the vertical door locking system seen in FIGS. 1 and 4.
Figure 3:
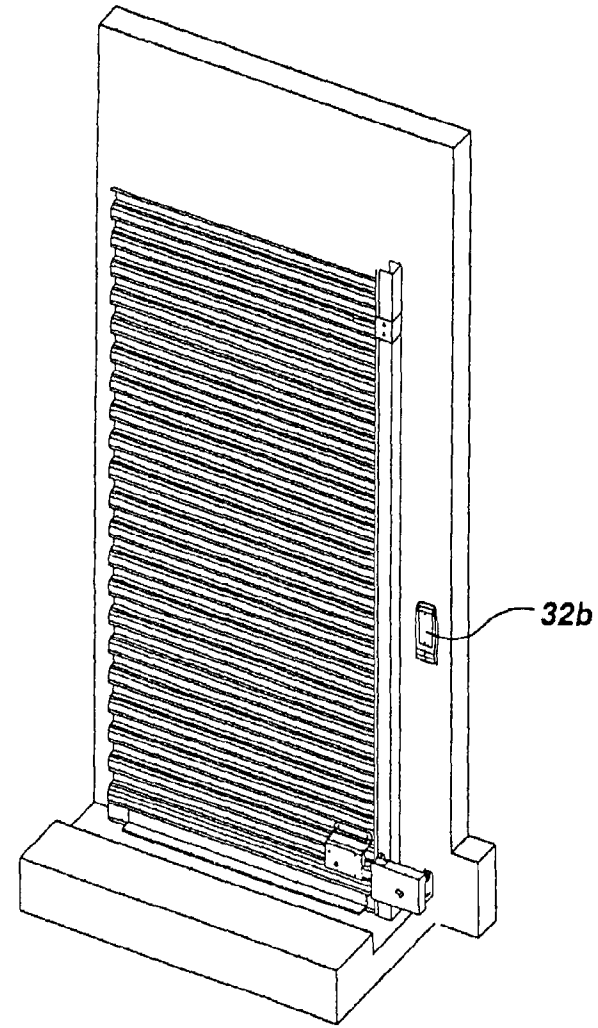
FIG. 3 is a perspective view from the inside of the secure area showing the inside of the vertical door and the vertical door locking system seen in FIG. 1.

A lock cylinder 18 is operable by a key 20 to horizontally retract a deadbolt 22 on the opposite side of the door (see FIGS. 3, 4 and 5). A deadbolt 22 extends outward from the door lock 12 and into engagement with striker 24. Striker 24 includes an upwardly open strike opening 26. The strike opening allows the deadbolt to enter or exit the striker while the deadbolt is fully extended.

The deadbolt 22 may be horizontally retracted (in the direction indicated by arrow 28) to horizontally disengage the deadbolt from the striker 24 by rotating key 20 in lock cylinder 18. See FIG. 2. However, this manual opening of the door is intended as a secondary method of unlocking the door and accessing the secure area behind the door. Accordingly, key 20 will typically be a master key for a multiple nearby vertical doors in the self-storage facility.

Primary access to the secure area is intended to occur by electrically operating a catch mechanism 30 (see FIGS. 6 and 7) mounted inside striker 24. The catch mechanism 30 is controlled by an electric lock controller 32*a*, 32*b* seen in FIGS. 1, 3 and 7. The electric lock controller includes an outer half 32*a* accessible by a customer and an inner half 32*b* mounted inside the secure area. The two halves are connected by cable 70.

The customer is provided with a secure access key which is entered into the electric lock controller and causes the electric catch in the striker to release the extended deadbolt 22. The access key may be in the form of a personal identification number (PIN) entered into a keypad 34 on the face of the lock controller 32. Alternatively, a proximity card, a smart card, a radio frequency identification (RFID) tag or a conventional access card containing a magnetic stripe, similar to a credit card, may be used to present the secure access key to the electric lock controller to identify the person accessing the secure area.

Upon receiving the appropriate secure access key, the electric lock controller signals the catch mechanism in the striker 24 to release the deadbolt 22. The deadbolt 22 remains extended and, provided the electronic lock controller has released the catch mechanism 30, the vertical door 10 may be raised. The deadbolt 22 can then rise vertically out of the striker opening 26.

Figure 6:
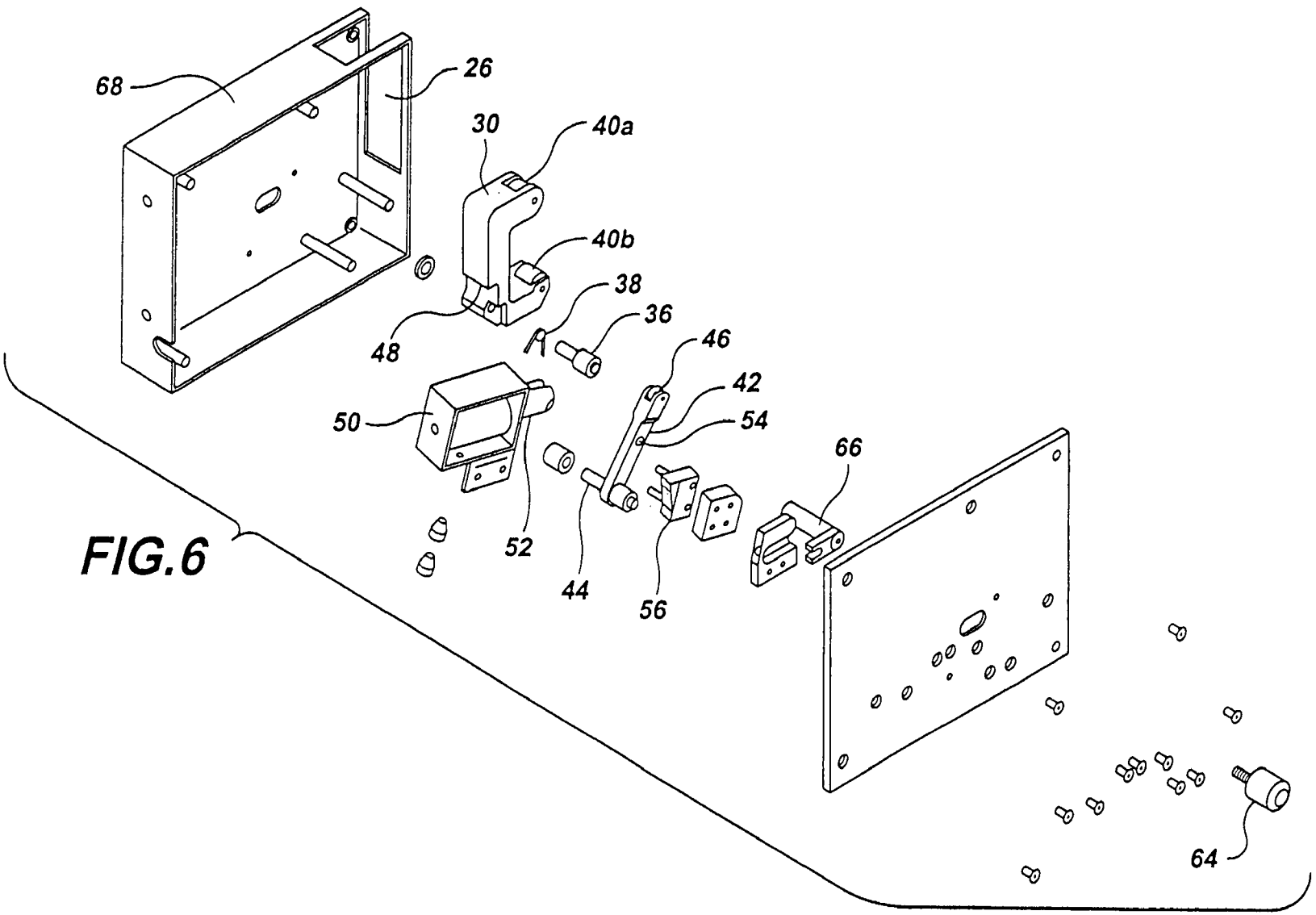
FIG. 6 is an exploded view of the striker portion of the vertical door locking system seen in FIG. 1.
Figure 7:
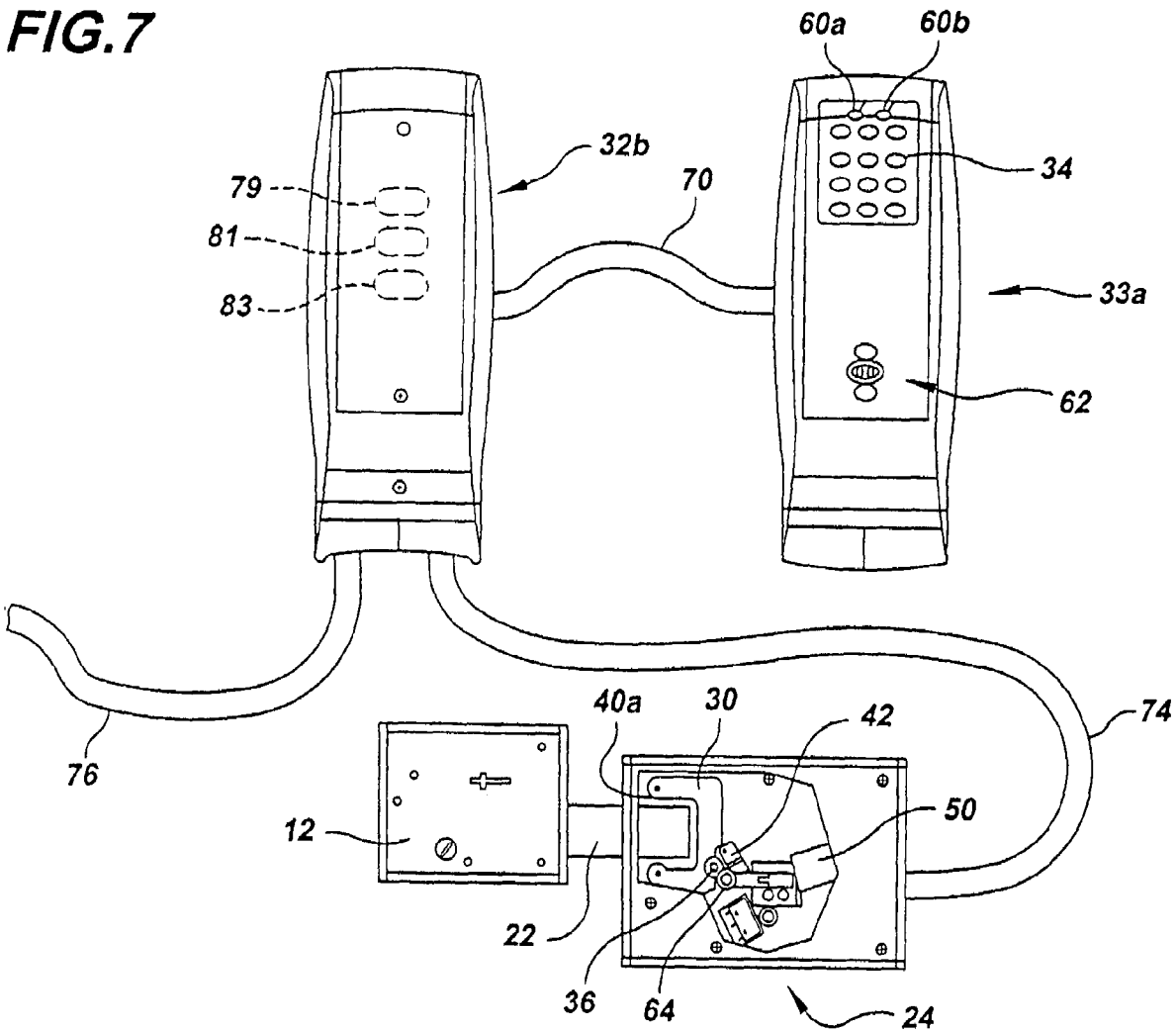
FIG. 7 shows front elevational views of the door lock, striker and inner and outer electronic controller portions of the vertical door locking system seen in FIG. 1.

FIGS. 6 and 7 show the operation of the striker 24. Catch mechanism 30 pivots on pivot 36 between an engaged position, shown in FIG. 7, and a released position in which the upper roller 40*a* has pivoted to the right in FIG. 7 to allow the deadbolt 22 to rise vertically. A torsion spring 38 urges the catch mechanism 30 towards the released position.

The catch mechanism 30 also includes a lower roller 40*b*. As the vertical door is closed, the deadbolt 22 enters the strike opening 26. Referring to FIG. 7, as the deadbolt enters the strike opening, its lower surface contacts the lower roller 40*b* and the catch mechanism 30 pivots counterclockwise (FIG. 7) to the engaged position, with roller 40*a* moving over the deadbolt 22 to prevent it from being lifted out of the striker 24.

As the catch mechanism 30 pivots counterclockwise (FIG. 7) towards the engaged position, locking arm 42 pivots counterclockwise (FIG. 7) on pivot 44, from an initial unlocked position to the locked position seen of FIG. 7. Referring to FIG. 6, locking arm 42 includes a roller 46, which enters lock cavity 48 on the catch mechanism 30 to prevent the catch mechanism from returning to the disengaged position.

Solenoid 50 includes a solenoid rod 52 with a forked end connected to the locking arm 42 with a pin that extends through hole 54. When energized, the solenoid 50 pulls the locking arm towards the solenoid and disengages roller 46 from locking cavity 48 thereby allowing the catch mechanism to pivot to the released position under the influence of spring 38.

Striker 24 includes a switch 56 connected to sense the operation of the catch mechanism. When the locking arm 42 is engaged in the locking cavity 48, the switch signals the lock controller 32*a*, 32*b* that the catch is in the engaged position and the door is locked. The accessible half 32*a* of the lock controller is provided with a pair of light emitting diodes (LEDs) 60*a* and 60*b*. One LED is preferably red to indicate that the door is unlocked and the other LED is preferably green to indicate that the door is locked.

A magnetic card reader, a proximity detector, an RFID receiver or other identification receiver may be located at 62 in addition to or instead of the keypad to receive a secure access key that identifies the customer as an authorized individual. Upon receipt of the correct secure access key, the electric lock controller 32*a*, 32*b* signals the striker 24 to open the lock by operating the solenoid 50. The motion of the solenoid rod 52 pulls the locking arm 42 out of the locking cavity 48 and allows the catch 30 to rotate on pivot 36 so that the door may be lifted vertically to vertically raise the deadbolt out of opening 26.

The striker 24 is also provided with a mechanical override knob 64 that operates slide 66 which pivots locking lever 42 about pivot 44 to mechanically disengage the locking lever 42 from locking cavity 48 and thereby provide an emergency exit from the secure area. This mechanical override from the inside of the secure area requires no key and prevents a customer from being locked inside the secure area. It is in addition to the mechanical override available from outside the secure area via door lock 12 which requires a key to retract deadbolt 22.

The striker 24 is shown in FIGS. 4, 5 and 7 with the case 68 of the striker oriented generally parallel to the plane of the door 10. However, the internal components of the striker are designed such that the striker case may be oriented perpendicular to the plane of the door. When the case is turned perpendicular, the striker opening is reshaped and the upper roller 40*a* rides over the top of the deadbolt 22 from the side of the deadbolt instead of from the end of the deadbolt as previously described. In this alternative design, the strike opening 26 is a perpendicular opening instead of being substantially parallel to the striker body 68. This alternative configuration is suitable for tight installation spaces.

Figure 8:
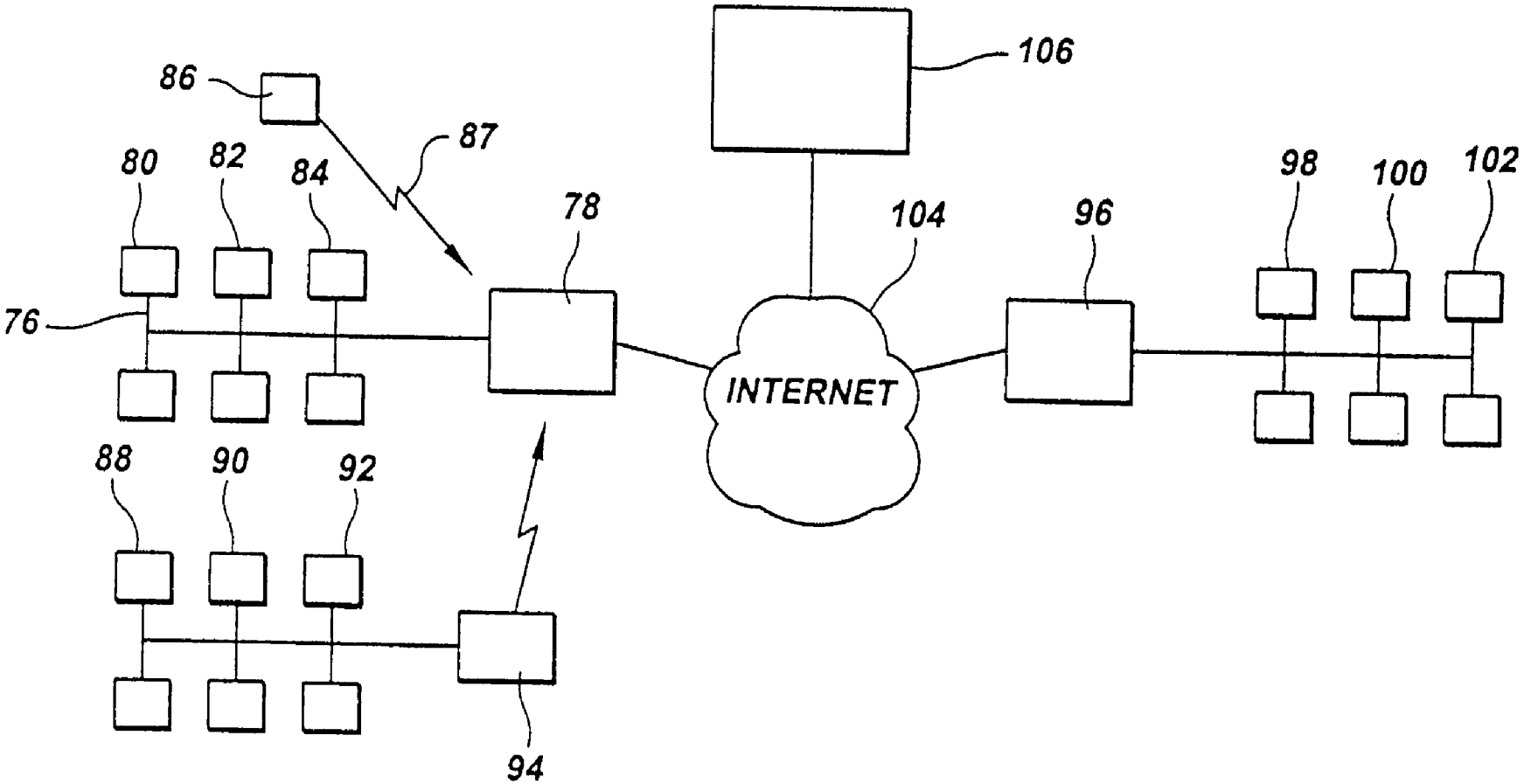
FIG. 8 is a block diagram of the present invention showing multiple electronically controller vertical door locks connected to remotely located control systems which are connected in turn to a central office control system. Connections are made both wirelessly and through the Internet.

Referring to FIG. 7, the interior half 32*b* of the electronic lock controller is connected to the striker 24 via cable 74. Cable 74 is routed inside the secure area behind the locked vertical door. Referring to FIG. 8, multiple secure areas 80, 82 and 84 having corresponding lock controllers may be connected via cable 76 to a remotely located control system 78. Alternatively, location 86 may be wirelessly connected via a wireless link 87 to the remotely located control system 78. The wireless link 87 may be of any conventional type.

It will be understood that 80, 82, 84 and 86 all include an electric lock controller, a door lock and a striker, as previously described. These components are fixed to corresponding vertical doors and adjacent doorframes and/or guide rails for vertical door rollers and control access to separate secured areas that may be rented by customers.

Although it is preferred that each vertical door have both a mechanically operated door lock with a retractable deadbolt, the invention may also be implemented with fixed non-retractable deadbolts.

The electric lock controllers at each vertical door have the ability to respond to multiple different secure access keys stored in storage memory 79, and the remotely located control system 78 can individually disable separate secure access keys or enable the secure access keys. Moreover, the electric lock controller monitors time and date of entry of secure access keys to monitor which access keys are used to enter the secure area and the time and date of each entry. Additional transaction data of any desired type may be stored.

The lock controllers also include a processor 81 and a clock 83. Alternatively, a clock and storage memory may be provided by the remotely located control system. The lock controller may be connected to monitor other sensors, such as fire, motion or security detectors.

The remotely located control system 78 is typically located on the premises of the self-storage facility. A further configuration seen in FIG. 8, includes multiple additional locking systems at additional secure areas 88, 90 and 92 connected to a wireless transceiver 94 that is wirelessly connected to the remotely located control system 78. This configuration might be employed when the additional secure areas are available for rent at a relatively nearby location, such as across the street or when separated by some physical barrier that prevents connection between the remotely located control system 78 and the secure areas 88, 90 and 92.

The remotely located control system 78 includes a database of customers, and has the ability to set and disable secure access keys at individual secure areas, remotely lock or unlock secure areas, record access times, etc. The connection 76 and 88 to the lockers may also be used for monitoring fire, burglary or other unauthorized access to the addition of additional sensors that supply information to the remotely located control system 78.

The present invention also contemplates the integration of at least one additional remotely located control system 96 monitoring secure areas 98, 100 and 102 through the Internet 104 by a central office control system 106. The central office control system 106 may be staffed 24 hours a day and is capable of receiving payment from customers needing access at locations corresponding to control systems 78 or 96. A customer would contact the central office control system and, upon making an overdue payment, the central office control system 106 would actuate the lock and/or re-enable the customer's secure access key via the Internet and the corresponding remotely located control system.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A vertical door locking system comprising:

a deadbolt:

a striker including:

an upwardly open strike opening for vertically receiving the deadbolt, a door for horizontally moving the deadbolt into the strider and an electrically operated catch mechanism for engaging and releasing the deadbolt from the strike opening;

the deadbolt and striker being adapted for mounting, one to a door that opens and closes vertically to provide access to a secure area and the other to an adjacent fixed mounting point, the door lock and striker cooperating to lock the door and prevent it from being opened vertically when the deadbolt is engaged by the striker catch mechanism; and an electric lock controller adapted for mounting outside the secure area and connected to the striker to electrically operate the catch mechanism in response to receiving a secure access key and release the deadbolt from the strike opening thereby providing access to the secure area.

2. The vertical door locking system according to claim 1 wherein the electric lock controller further includes a status indicator to indicate the striker catch mechanism has released the deadbolt to permit access to the secure area.

3. The vertical door locking system according to claim 1 wherein the striker further includes a switch providing a signal to indicate the striker catch mechanism has released the deadbolt to permit access to the secure area.

4. The vertical door locking system according to claim 1 wherein the electric lock controller further includes a keypad and the secure access key comprises a selected personal identification number, the electric lock controller releasing the deadbolt to permit access to the secure area when the selected personal identification number is entered into the electric lock controller via the keypad.

5. The vertical door locking system according to claim 1 wherein the electric lock controller further includes a wireless receiver and the secure access key comprises a selected access code wirelessly transmitted to the electric lock controller, the electric lock controller releasing the deadbolt to permit access to the secure area when the selected access code is received by the wireless receiver.

6. The vertical door locking system according to claim 1 wherein the electric lock controller further includes a card reader and the secure access key comprises a selected access code magnetically stored on an access card, the electric lock controller releasing the deadbolt to permit access to the secure area when a user swipes the access card in the card reader and the card reader detects the selected access code stored thereon.

7. The vertical door locking system according to claim 1 wherein the electric lock controller may be temporarily disabled to prevent access to the secure area.

8. The vertical door locking system according to claim 1 wherein the striker includes an override accessible from within the secure area to release the deadbolt from the strike opening and allow the vertical door to open to exit the secure area.

9. The vertical door locking system according to claim 1 wherein the striker is mountable to a vertical track for the door and the deadbolt is mountable to a panel of the door.

10. The vertical door locking system according to claim 1 wherein the electric lock controller is responsive to at least one additional secure access key, the electric lock controller releasing the deadbolt in response to each of the secure access keys.

11. The vertical door locking system according to claim 1 wherein the electric lock controller includes a storage memory for storing transaction data related to accessing the secure area.

12. The vertical door locking system according to claim 11 wherein the transaction data includes a date and time the electric lock controller releases the deadbolt to permit access to the secure area.

13. The vertical door locking system according to claim 11 wherein the transaction data includes a date and time of access and an identification corresponding to the secure access key.

14. The vertical door locking system according to claim 1 wherein the catch mechanism automatically engages the deadbolt when the door is vertically closed.

15. The vertical door locking system according to claim 1 wherein the catch mechanism pivots between an engaged position and a released position.

16. The vertical door locking system according to claim 15 wherein the catch mechanism includes a locking arm, the locking arm pivoting between a locked position to lock the catch mechanism in the engaged position and an unlocked position where the catch mechanism may move to the released position, the striker further including a solenoid connected to the locking arm for moving the locking arm between the locked and unlocked positions.

17. The vertical door locking system according to claim 16 further including a manual override connected to the locking arm and accessible from outside the striker, the manual override allowing a user to pivot the locking arm to the unlocked position and disengage the deadbolt from the striker to open the vertical door and exit the secure area.

18. The vertical door locking system according to claim 1 wherein the catch mechanism includes at least one roller contacting the deadbolt when the deadbolt is engaged by the catch mechanism.

19. The vertical door locking system according to claim 1 wherein the striker further includes a switch connected to the lock controller and operated by the catch mechanism to provide a signal to the controller indicating the striker catch mechanism has released the deadbolt to permit access to the secure area, and wherein the lock controller includes a storage memory for storing an indication of the date and time the switch has indicated the striker catch mechanism has released the deadbolt.

20. The vertical door locking system according to claim 1 wherein the striker further includes a switch connected to the lock controller and operated by the catch mechanism to provide a signal to the controller indicating the striker catch mechanism has released the deadbolt to permit access to the secure area, and wherein the lock controller includes an illuminated status indicator having a first state to indicate the deadbolt is released and a second state to indicate the deadbolt is engaged by the catch mechanism.

21. A vertical door locking system comprising:

a door lock including:

a deadbolt that moves horizontally between an extended position and a retracted position; and a lock mechanism connected to move the deadbolt between the extended position and the retracted position;

a striker including:

an upwardly open strike opening for vertically receiving the door lock deadbolt, and an electrically operated catch mechanism for engaging and releasing the deadbolt from the strike opening;

the door lock and striker being adapted for mounting, one to a door that opens and closes vertically to provide access to a secure area and the other to an adjacent fixed mounting point, the door lock and striker cooperating to lock the door and prevent it from being opened vertically when the deadbolt is extended and engaged by the striker catch mechanism; and an electric lock controller adapted for mounting outside the secure area and connected to the striker to electrically operate the catch mechanism in response to receiving a secure access key and release the deadbolt from the strike opening thereby providing access to the secure area, the door lock providing an alternative access to the secure area by horizontally retracting the deadbolt to disengage the deadbolt from the striker.

22. The vertical door locking system according to claim 21 wherein the electric lock controller further includes a status indicator to indicate the striker catch mechanism has released the deadbolt to permit access to the secure area.

23. The vertical door locking system according to claim 21 wherein the striker further includes a switch providing a signal to indicate the striker catch mechanism has released the deadbolt to permit access to the secure area.

24. The vertical door locking system according to claim 21 wherein the electric lock controller further includes a keypad and is responsive to a secure access key comprising a selected personal identification number, the electric lock controller releasing the deadbolt to permit access to the secure area when the selected personal identification number is entered into the electric lock controller via keypad.

25. The vertical door locking system according to claim 21 wherein the electric lock controller further includes a wireless receiver and is responsive to a secure access key comprising a selected access code wirelessly transmitted to the electric lock controller, the electric lock controller releasing the deadbolt to permit access to the secure area when the selected access code is received by the wireless receiver.

26. The vertical door locking system according to claim 21 wherein the electric lock controller further includes a card reader and is responsive to a secure access key comprising a selected access code magnetically stored on an access card, the electric lock controller releasing the deadbolt to permit access to the secure area when a user swipes the access card in the card reader and the card reader detects the selected access code stored thereon.

27. The vertical door locking system according to claim 21 wherein the electric lock controller may be temporarily disabled to prevent access to the secure area.

28. The vertical door locking system according to claim 21 wherein the striker includes an override accessible from within the secure area to release the deadbolt from the strike opening and allow the vertical door to open to exit the secure area.

29. The vertical door locking system according to claim 21 wherein the striker is mountable to a vertical track for the door and the deadbolt is mountable to a panel of the door.

30. The vertical door locking system according to claim 21 wherein the lock mechanism of the door lock includes a lock cylinder mechanically operated by a key.

31. The vertical door locking system according to claim 21 wherein the electric lock controller includes a storage memory for storing transaction data related to accessing the secure area.

32. The vertical door locking system according to claim 31 wherein the transaction data includes a date and time the electric lock controller releases the deadbolt to permit access to the secure area.

33. The vertical door locking system according to claim 31 wherein the transaction data includes a date and time of access and an identification corresponding to the secure access key.

34. The vertical door locking system according to claim 21 wherein the catch mechanism automatically engages the deadbolt when the door is vertically closed.

35. The vertical door locking system according to claim 21 wherein the catch mechanism pivots between an engaged position and a released position.

36. The vertical door locking system according to claim 35 wherein the catch mechanism includes a locking arm, the locking arm pivoting between a locked position to lock the catch mechanism in the engaged position and an unlocked position where the catch mechanism may move to the released position, the striker further including a solenoid connected to the locking arm for moving the locking arm between the locked and unlocked positions.

37. The vertical door locking system according to claim 36 further including a manual override connected to the locking arm and accessible from outside the striker, the manual override allowing a user to pivot the locking arm to the unlocked position and disengage the deadbolt from the striker to open the vertical door and exit the secure area.

38. The vertical door locking system according to claim 21 wherein the catch mechanism includes at least one roller contacting the deadbolt when the deadbolt is engaged by the catch mechanism.

39. The vertical door locking system according to claim 21 wherein the striker further includes a switch connected to the lock controller and operated by the catch mechanism to provide a signal to the controller indicating the striker catch mechanism has released the deadbolt to permit access to the secure area, and wherein the lock controller includes a storage memory for storing an indication of the date and time the switch has indicated the striker catch mechanism has released the deadbolt.

40. The vertical door locking system according to claim 21 wherein the striker further includes a switch connected to the lock controller and operated by the catch mechanism to provide a signal to the controller indicating the striker catch mechanism has released the deadbolt to permit access to the secure area, and wherein the lock controller includes an illuminated status indicator having a first state to indicate the deadbolt is released and a second state to indicate the deadbolt is engaged by the catch mechanism.

41. The vertical door locking system according to claim 21 further including a remotely located control system connected to the electric lock controller and operable to remotely disable access to the secure area via the electric lock controller.

42. The vertical door locking system according to claim 41 wherein the remotely located control system is connected to control a plurality of additional electric lock controllers corresponding to a plurality of additional secure areas.

43. The vertical door locking system according to claim 41 wherein the remotely located control system is connected to monitor a plurality of additional electric lock controllers corresponding to a plurality of additional secure areas, the remotely located control system recording transaction data received from the plurality of additional electric lock controllers.

44. The vertical door locking system according to claim 41 wherein the remotely located control system is connected to the electric lock controller via a wireless connection.

45. The vertical door locking system according to claim 41 further including a central office control system connected to the remotely located control system via a network and also operable to remotely control access to the secure area via the electric lock controller.

46. The vertical door locking system according to claim 45 wherein the network is a packet switching network.

47. The vertical door locking system according to claim 45 wherein the central office control system is connected to at least one additional remotely located control system via the network.

48. A vertical door locking system comprising:

a door lock including:

a deadbolt that moves horizontally between an extended position and a retracted position; and a lock mechanism connected to move the deadbolt between the extended position and the retracted position;

a striker including:

an upwardly open strike opening for vertically receiving the door lock deadbolt, and an electrically operated catch mechanism for engaging and releasing the deadbolt from the strike opening;

the door lock and striker being adapted for mounting, one to a door that opens and closes vertically to provide access to a secure area and the other to an adjacent fixed mounting point, the door lock and striker cooperating to lock the door and prevent it from being opened vertically when the deadbolt is extended and engaged by the striker catch mechanism;

an electric lock controller responsive to a secure access key and adapted for mounting outside the secure area and proximate the door, the electric lock controller being connected to the striker to electrically operate the catch mechanism and release the deadbolt from the strike opening thereby providing access to the secure area by a first method when the secure access key is provided to the lock controller, the door lock providing a second access method to the secure area by horizontally retracting the deadbolt to disengage the deadbolt from the striker; and a remotely located control system connected to the electric lock controller and operable to remotely disable access to the secure area via the electric lock controller.

49. A vertical door locking system comprising:

a door lock including:

a deadbolt that moves horizontally between an extended position and a retracted position; and a lock mechanism connected to move the deadbolt between the extended position and the retracted position;

a striker including:

an upwardly open strike opening for vertically receiving the door lock deadbolt, and an electrically operated catch mechanism for engaging and releasing the deadbolt from the strike opening;

the door lock and striker being adapted for mounting, one to a door that opens and closes vertically to provide access to a secure area and the other to an adjacent fixed mounting point, the door lock and striker cooperating to lock the door and prevent it from being opened vertically when the deadbolt is extended and engaged by the striker catch mechanism;

an electric lock controller responsive to a secure access key and adapted for mounting outside the secure area and proximate the door, the electric lock controller being connected to the striker to electrically operate the catch mechanism and release the deadbolt from the strike opening thereby providing access to the secure area by a first method when the secure access key is provided to the lock controller, the door lock providing a second access method to the secure area by horizontally retracting the deadbolt to disengage the deadbolt from the striker;

a remotely located control system connected to the electric lock controller and operable to remotely control access to the secure area via the electric lock controller; and a central office control system connected to the remotely located control system via a network and also operable to remotely control access to the secure area via the electric lock controller.

* * * * *

UNITED STATES PATENT AND TRADEMARK OFFICE

CERTIFICATE OF CORRECTION

PATENT NO. : 7,032,418 B2
APPLICATION NO. : 10/828566
DATED : April 25, 2006
INVENTOR(S) : Martin et al.

It is certified that error appears in the above-identified patent and that said Letters Patent is hereby corrected as shown below:

On Title Page, Item (75) Inventors:

"Herb Guck, Roswell, CT" should read - - Herb Guck, Roswell, GA - -.

Col. 6, line 64, after "door" insert - - lock - - .

Col. 6, line 65, "strider" should read - - striker - - .

Signed and Sealed this

Fifteenth Day of August, 2006

JON W. DUDAS
*Director of the United States Patent and Trademark Office*